US008789250B2

(12) United States Patent
Meiser et al.

(10) Patent No.: US 8,789,250 B2
(45) Date of Patent: Jul. 29, 2014

(54) METHOD OF FORMING SHEET METAL CASKET SHELL

(75) Inventors: Daniel G. Meiser, Wilder, KY (US); Ilija Rojdev, Cincinnati, OH (US)

(73) Assignee: Batesville Services, Inc., Batesville, IN (US)

( * ) Notice: Subject to any disclaimer, the term of this patent is extended or adjusted under 35 U.S.C. 154(b) by 15 days.

(21) Appl. No.: 13/566,236

(22) Filed: Aug. 3, 2012

(65) Prior Publication Data

US 2013/0031757 A1 Feb. 7, 2013

Related U.S. Application Data

(60) Provisional application No. 61/515,515, filed on Aug. 5, 2011.

(51) Int. Cl.
*A61G 17/00* (2006.01)

(52) U.S. Cl.
USPC ..... 27/6; 413/1; 72/379.4; 228/173.6

(58) Field of Classification Search
USPC ..... 27/6, 2; 413/1–4; 29/525.14, 469; 72/379.4, 199, 214, 67, 80, 82, 83, 72/124; 228/173.6
See application file for complete search history.

(56) References Cited

U.S. PATENT DOCUMENTS

| | | | |
|---|---|---|---|
| 801,264 | A | 10/1905 | Post |
| 2,529,088 | A | 11/1950 | Leake |
| 2,867,029 | A | 1/1959 | Hillenbrand |
| 2,976,611 | A | 3/1961 | Giffen |
| 3,601,011 | A | 8/1971 | Arnes |
| 4,157,609 | A | 6/1979 | Schutz |
| 4,185,370 | A | 1/1980 | Evans |
| 4,361,021 | A | 11/1982 | McVay et al. |
| 4,931,239 | A | 6/1990 | Hosoi et al. |
| 4,982,487 | A | 1/1991 | Maruko et al. |
| 5,306,058 | A | 4/1994 | Sturrus et al. |
| 5,499,438 | A | 3/1996 | Schutz |
| 5,875,529 | A | 3/1999 | Ollier |
| 5,984,163 | A | 11/1999 | Meier et al. |
| 6,268,066 | B1 | 7/2001 | Swain |

(Continued)

FOREIGN PATENT DOCUMENTS

WO 00/71278 A1 11/2000

OTHER PUBLICATIONS

Lucas Catalog, 11 pages, undated but before at least Apr. 4, 2011.

*Primary Examiner* — William Miller
(74) *Attorney, Agent, or Firm* — Wood, Herron & Evans, LLP

(57) ABSTRACT

A method of forming a portion of a sheet metal casket shell comprises supporting a piece of sheet metal on one side with a female die having a center die portion and opposite end die portions configured to pivot relative to the center die portion, supporting the piece of sheet metal on the opposite side with a male die having a center die portion and opposite end die portions, and pivoting the end die portions of the female die relative to the center die portion of the female die to cause the opposite ends of the piece of sheet metal to fold around the end die portions of the male die. The method can be repeated with a second piece of sheet metal thereby forming two shell halves which can be welded together to form the shell.

20 Claims, 8 Drawing Sheets

(56) References Cited

U.S. PATENT DOCUMENTS

| | | | | |
|---|---|---|---|---|
| 6,301,758 | B1 | 10/2001 | Biondo et al. | |
| 6,530,254 | B2 | 3/2003 | Beierling | |
| 6,764,559 | B2 | 7/2004 | Li et al. | |
| 6,948,141 | B1 | 9/2005 | Satya et al. | |
| 7,247,264 | B2 | 7/2007 | Buchler et al. | |
| 7,377,016 | B2 | 5/2008 | Kelly | |
| 7,464,574 | B2 | 12/2008 | Durney et al. | |
| 8,353,094 | B2 * | 1/2013 | Parker | 29/525.14 |
| 2004/0181870 | A1 | 9/2004 | Bohacik et al. | |
| 2007/0101559 | A1 | 5/2007 | Poteet | |
| 2010/0272542 | A1 | 10/2010 | Mueller et al. | |
| 2010/0275422 | A1 | 11/2010 | Rojdev et al. | |
| 2011/0296656 | A1 | 12/2011 | Filipek et al. | |
| 2012/0096692 | A1 | 4/2012 | Filipek et al. | |
| 2012/0247166 | A1 * | 10/2012 | Meiser et al. | 72/203 |

* cited by examiner

METHOD OF FORMING SHEET METAL CASKET SHELL

RELATED APPLICATIONS

This application claims the priority benefit of U.S. Provisional Patent Application No. 61/515,515 filed Aug. 5, 2011, which is hereby incorporated by reference herein as if fully set forth in its entirety.

FIELD OF THE INVENTION

This invention relates generally to caskets, and more particularly to methods of forming sheet metal caskets.

BACKGROUND OF THE INVENTION

One commonly employed process currently utilized to form sheet metal casket shells is as follows: Two side panels are blanked from a coil of sheet steel (or other suitable sheet metal), and two end panels are blanked from the coil. Next, both side panels and both end panels are stamped to form the desired cross-sectional profile of the shell side walls and end walls. Next, the four walls are loaded onto a weld fixture and welded together by welders, and finally the four welds are ground smooth with grinders. At some point along the way a bottom wall or panel is welded to the side walls and the end walls. The corners of the casket shell are typically formed as a part of the end panels. Thus, the weld lines where the side panels are welded to the end panels are located on the ends of the side panels, thus being visible when the casket shell is viewed from the front (or rear).

This current process of forming sheet metal casket shells includes a number of disadvantages. Each panel requires at least one blanking operation along with one or two stamping operations. The sheets must be loaded into a first press to be blanked, and then moved to a second press to be stamped. The panels are then moved to a new location where they are loaded onto a fixture that holds the panels in the correct assembled orientation. Each corner is then welded either manually or robotically. The corners contain intricate profiles which add complexity to the welding operation. The welded shell is then moved to a new location where each weld is manually rough ground. Because of the intricate profiles the grinding must be done at a slower pace to insure that only unwanted weld is removed. The shell is then placed on line where the corners are eventually manually finish sanded. All of these operations are labor intensive, and because of the repeated handling of the parts, the parts are susceptible to dents and dings. The welding operations require energy for the welder and consume welding wire. The grinding and sanding operations require energy, consume numerous sanding discs, and produce dust and debris.

It is desirable to improve upon this current method of forming sheet metal casket shells.

SUMMARY OF THE INVENTION

In one aspect, a method of forming a portion of a sheet metal casket shell, the casket shell having a pair of opposed side walls and a pair of opposed end walls, is provided. The portion of the casket shell is formed from a piece of sheet metal having a desired profile, opposite ends, and a length about equal to the combined length of one of the side walls and one of the end walls of the casket shell. The method comprises supporting the piece of sheet metal on one side with a female die having a center die portion and opposite end die portions configured to pivot relative to the center die portion, supporting the piece of sheet metal on the opposite side with a male die having a center die portion and opposite end die portions, and pivoting the end die portions of the female die relative to the center die portion of the female die to cause the opposite ends of the piece of sheet metal to fold around the end die portions of the male die. The resulting portion of the casket shell has a side wall, about half of one end wall at one end of the side wall, and about half of the other end wall at the other end of the side wall.

The desired profile can be roll formed into the piece of sheet metal. The end die portions of the male die can be curved. For example, the end die portions of the male die can be rollers.

In another aspect, the above method is repeated with a second piece of sheet metal to form a second substantially identical portion of the casket shell. The first and second portions of the casket shell are positioned such that the half end walls of each portion abut, and the abutting half end walls are welded together.

In another aspect, a sheet metal casket shell having a pair of opposed side walls and a pair of opposed end walls, comprises a first casket shell portion formed from a first piece of sheet metal and having a desired profile, one side wall, about a first half of one end wall at one end of the one side wall, and about a first half of the other end wall at the other end of the one side wall, a second casket shell portion formed from a second piece of sheet metal and having the desired profile, the other side wall, about a second half of the one end wall at one end of the other side wall, and about a second half of the other end wall at the other end of the other side wall. Each of the first and second casket shell portions has a curved corner between its side wall and each of its half end walls. A first weld joins the first and second halves of the one end wall and a second weld joins the first and second halves of the other end wall.

In another aspect, a sheet metal casket comprises a sheet metal casket shell of the type described above and including a bottom wall, and a sheet metal lid closeable on the casket shell.

In another aspect, a method of forming a portion of a sheet metal casket shell, the casket shell having a pair of opposed side walls and a pair of opposed end walls, is provided. The portion of the casket shell is formed from a piece of sheet metal having a desired profile and opposite ends. The method comprises supporting the piece of sheet metal on one side with a female die having a center die portion and opposite end die portions configured to pivot relative to the center die portion, supporting the piece of sheet metal on the opposite side with a male die having a center die portion and opposite end die portions, and pivoting the end die portions of the female die relative to the center die portion of the female die to cause the opposite ends of the piece of sheet metal to fold around the end die portions of the male die, the resulting portion of the casket shell having a side wall, a portion of one end wall at one end of the side wall, and a portion of the other end wall at the other end of the side wall.

This method can be repeated with a second piece of sheet metal to form a second portion of the casket shell having a side wall, a portion of one end wall at one end of the side wall, and a portion of the other end wall at the other end of the side wall. The two casket shell portions can be mated, and the respective abutting end wall portions of the two casket shell portions can be welded together.

In another aspect, the resulting portion of the casket shell formed by the method can have either a) a side wall, a portion of one end wall at one end of the side wall, and a portion of the other end wall at the other end of the side wall, or b) an end wall, a portion of one side wall at one end of the end wall, and a portion of the other side wall at the other end of the end wall.

The invention thus provides a number of advantages over and above the commonly employed process for forming a sheet metal casket shell described above. For example, only two sheets of sheet metal must be handled instead of four separate sheets of sheet metal. The welding operation occurs in only two locations versus four locations. Also, the welds can be located on less conspicuous surfaces in that they can be located on the end walls rather than on the ends of the side walls. The inventive method requires less labor, produces a stronger overall two piece (side walls and end walls) shell, reduces the chances of the shell becoming damaged since less handling is required, requires fewer consumables such as welding wire and sanding discs and consequently consumes less energy, and is cleaner.

DETAILED DESCRIPTION OF THE DRAWINGS

Figure 1:
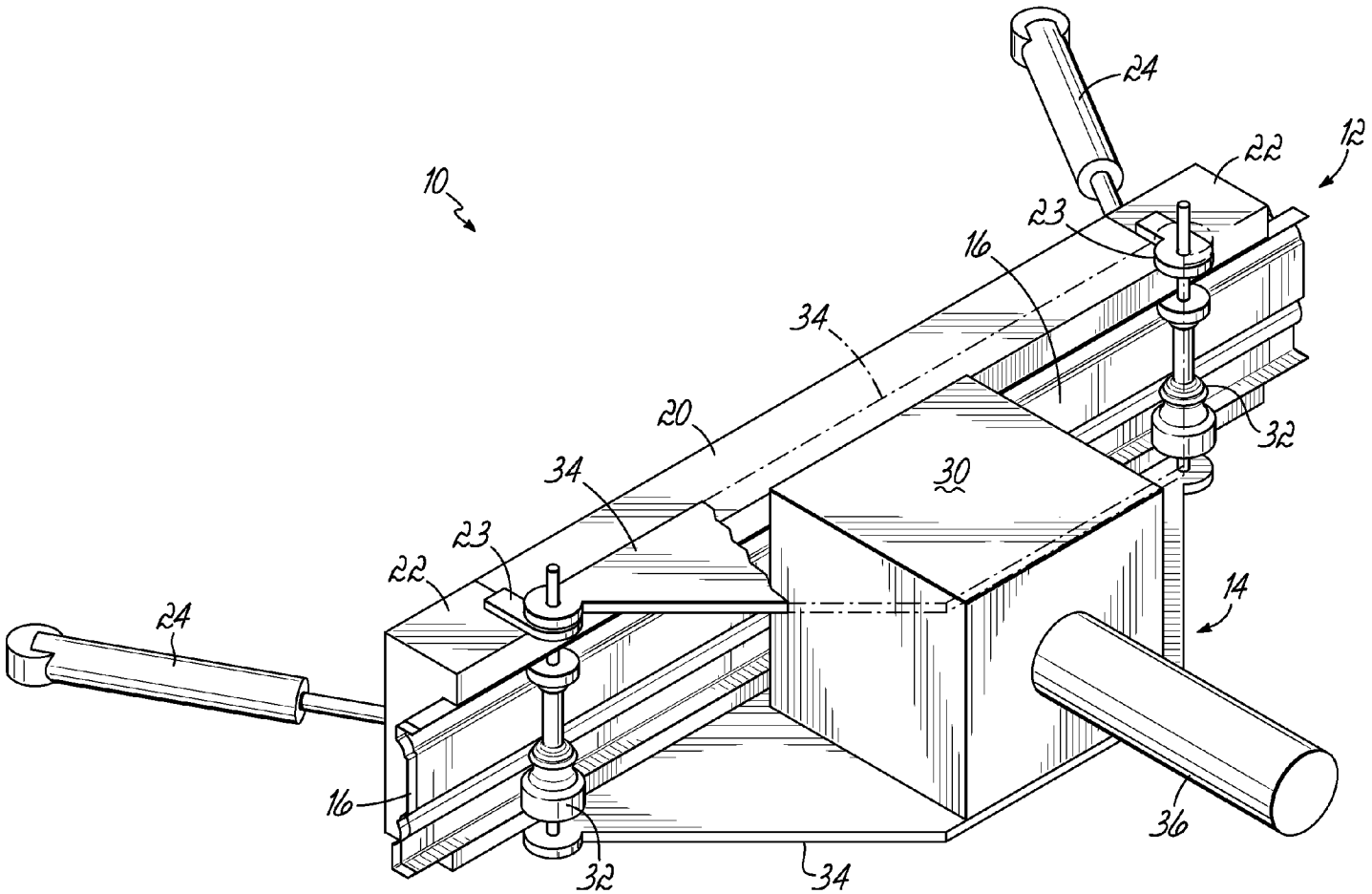
FIG. 1 is a perspective view of exemplary apparatus for forming a sheet metal casket shell according to the principles of the present invention.
Figure 2A:
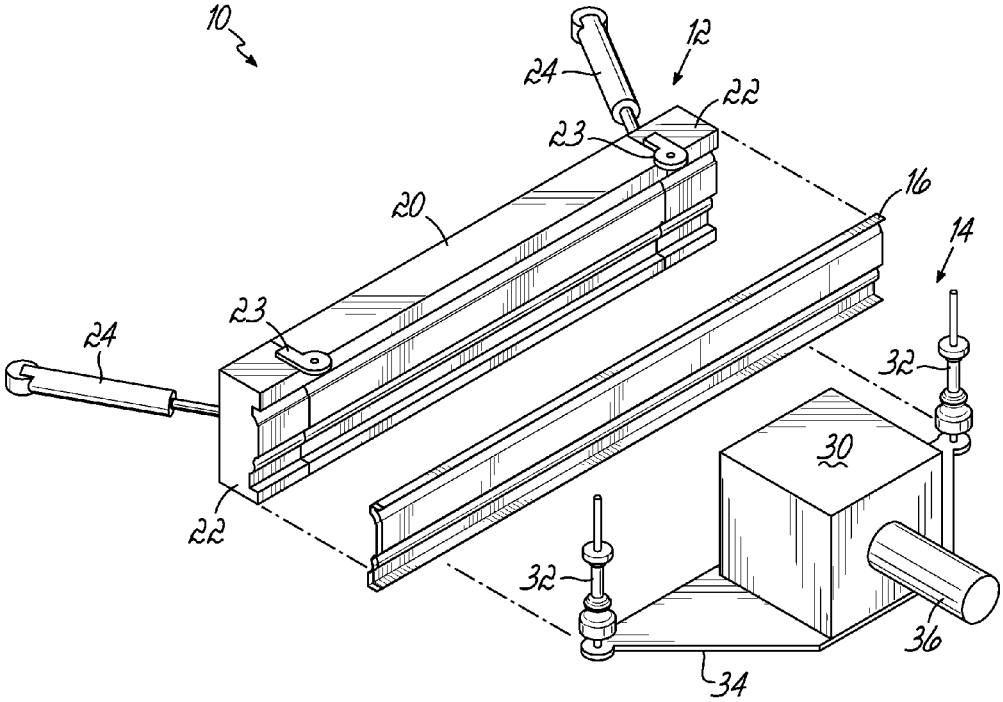
FIGS. 2A and 2B are perspective views of a piece of sheet metal being loaded into the apparatus of FIG. 1.
Figure 2B:
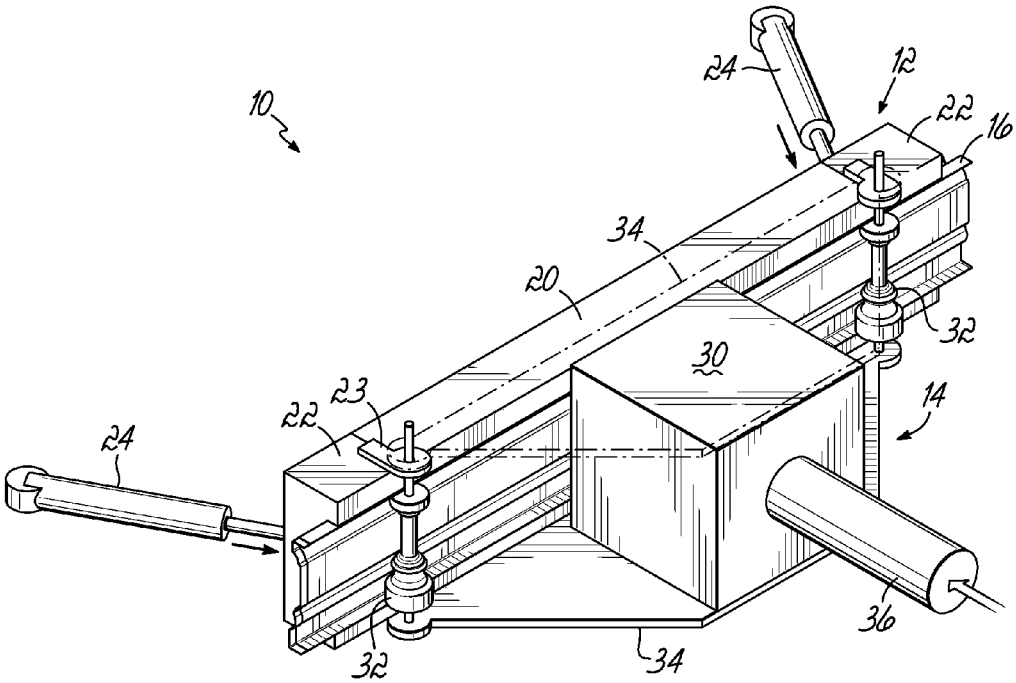
Figure 3:
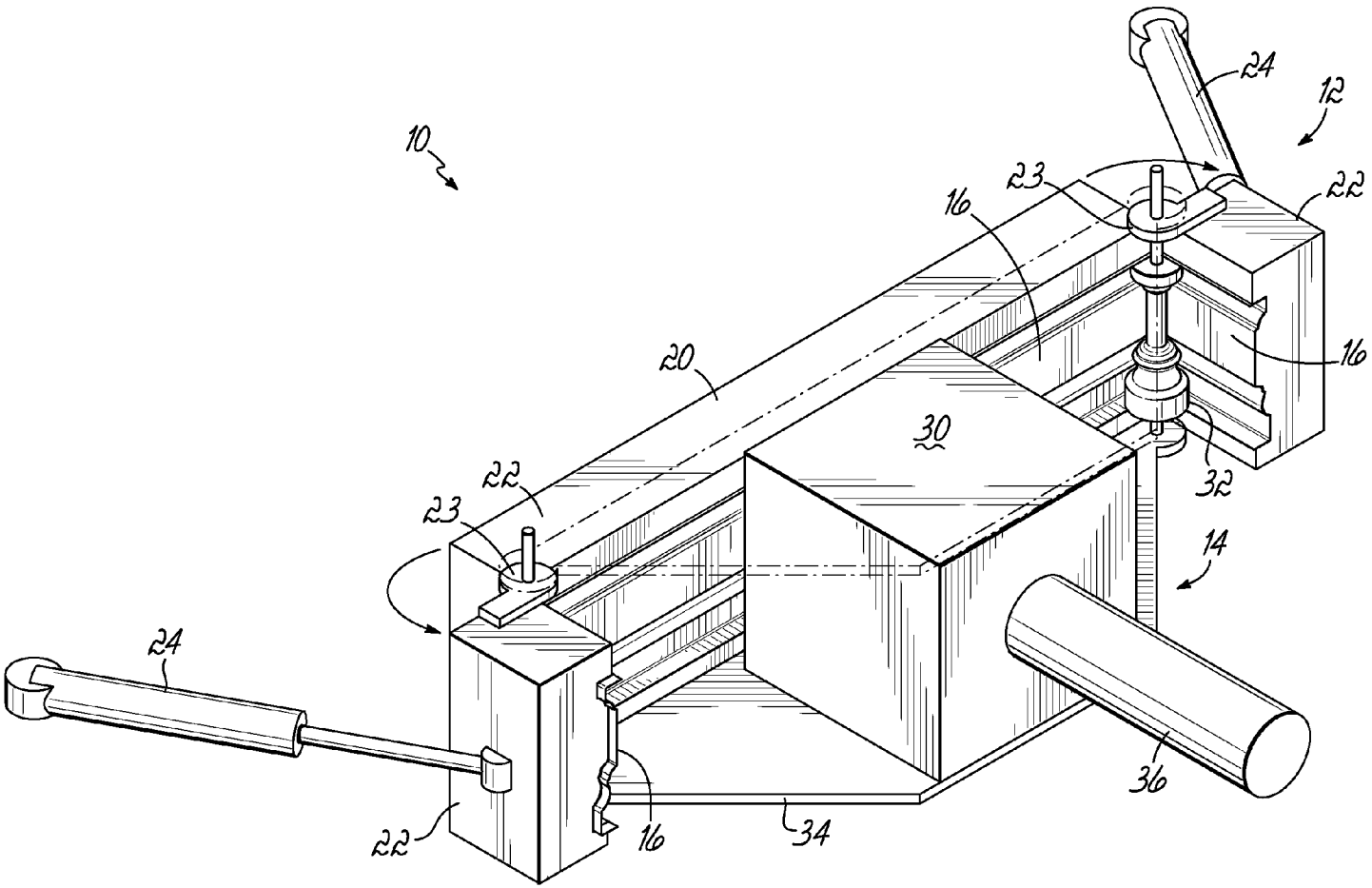
FIG. 3 is a perspective view of the apparatus of FIG. 2B shown with the opposite end die portions pivoted inwardly.
Figure 4A:
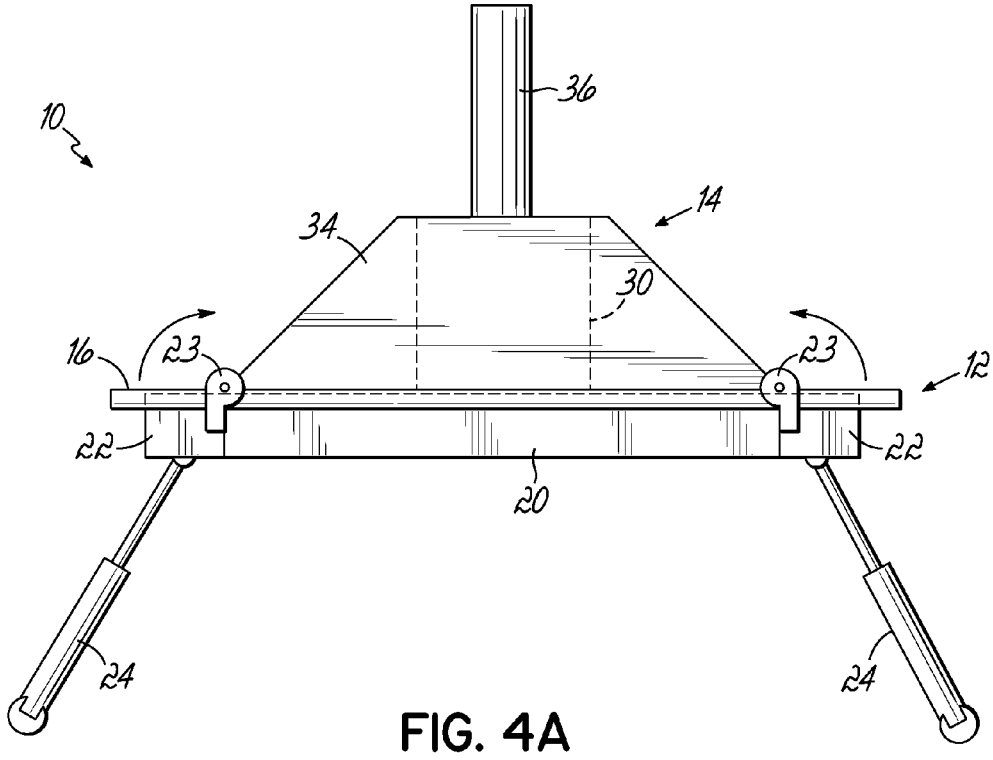
FIG. 4A is a top view of the apparatus shown in FIG. 2B.
Figure 4B:
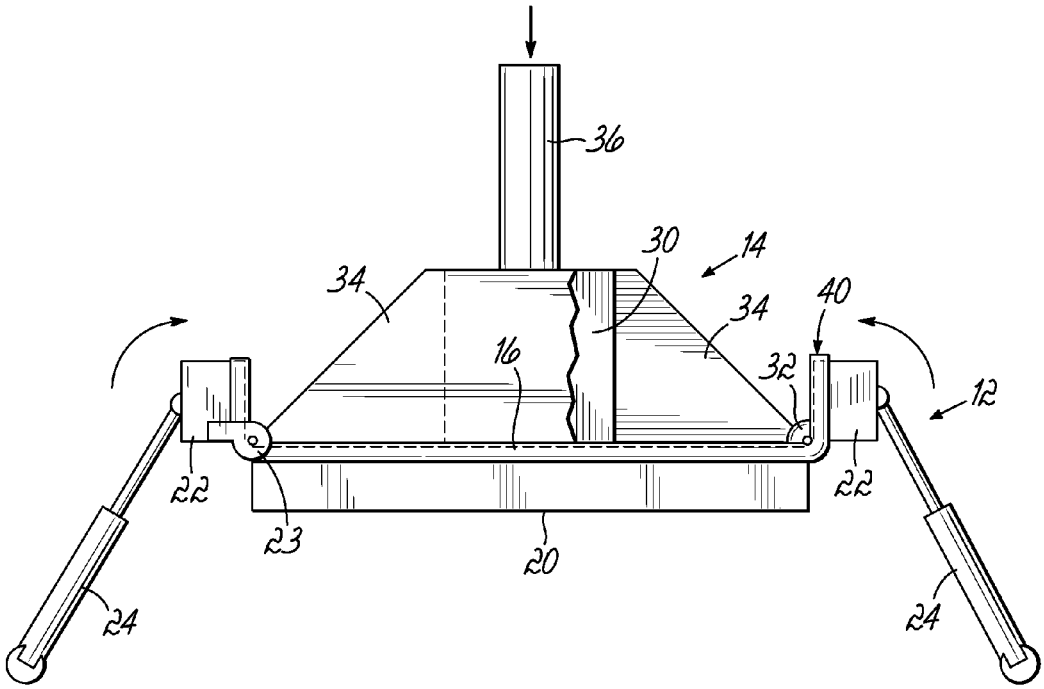
FIG. 4B is a top view of the apparatus shown in FIG. 3.

Referring first to FIG. 1, exemplary apparatus 10 for forming a sheet metal casket shell according to the principles of the present invention is illustrated. The apparatus 10 can include a female die 12 and a male die 14. A piece of sheet metal 16 having a desired cross-sectional profile pre-imparted thereto by roll forming, stamping, bending, etc. is shown positioned between the female die 12 and the male die 14. The female 12 and male 14 dies can be configured to mate with at least a portion of, or all of, the contour of the cross-sectional profile of the piece of sheet metal 16. The piece of sheet metal 16 can have a length about equal the combined length of one of the side walls and one of the end walls of the casket shell to be formed. As will be described, the process of one embodiment of the present invention forms the piece of sheet metal 16 into a portion of the casket shell having a side wall, a portion, for example about half, of one end wall at one end of the side wall, and a portion, for example about half, of the other end wall at the other end of the side wall.

Referring to FIGS. 1-4B, the female die 12 has a center die portion 20 and opposite end die portions 22, 22 that are configured to pivot relative to the center die portion 20. For example, the end or wing dies 22, 22 can be pivoted as by hinges 23, 23 to the center die 20, and can be actuated by hydraulic cylinders 24, 24, for example. The male die 14 has a center die portion 30 and opposite end die portions 32, 32 interconnected by upper and lower frame plates 34, 34 (FIG. 1). The end die portions 32, 32 of the male die 14 are curved so as to impart curved corners to the casket shell being fabricated. For example, the end die portions 32, 32 of the male die 14 can be rollers rotatably mounted on shafts or spindles or the like and can be configured to mate with at least a portion of, or all of, the contour of the profile of the piece of sheet metal 16. Alternatively, the end die portions 32, 32 can simply be nonrotating solid blocks configured to mate with at least a portion of, or all of, the contour of the profile of the piece of sheet metal 16. The male die 14 can be moveable relative to the female die 12 by a hydraulic cylinder 36, for example. The apparatus 10 can be oriented either generally horizontally or generally vertically.

Referring to FIGS. 2A-4B, the piece of sheet metal 16 to be formed into a casket shell half is loaded into the dies 12, 14. The male die 14, including the center portion 30 and the opposite end portions 32, 32, are forced against the piece of sheet metal 16 with the hydraulic cylinder 36. The opposite end die portions 22, 22 of the female die 12 are then pivoted inwardly with the hydraulic cylinders 24, 24 to rotate the ends of the piece of sheet metal 16 inwardly. The process is repeated with a second piece of sheet metal 16 to produce two shell halves 40, 40.

Figure 5A:
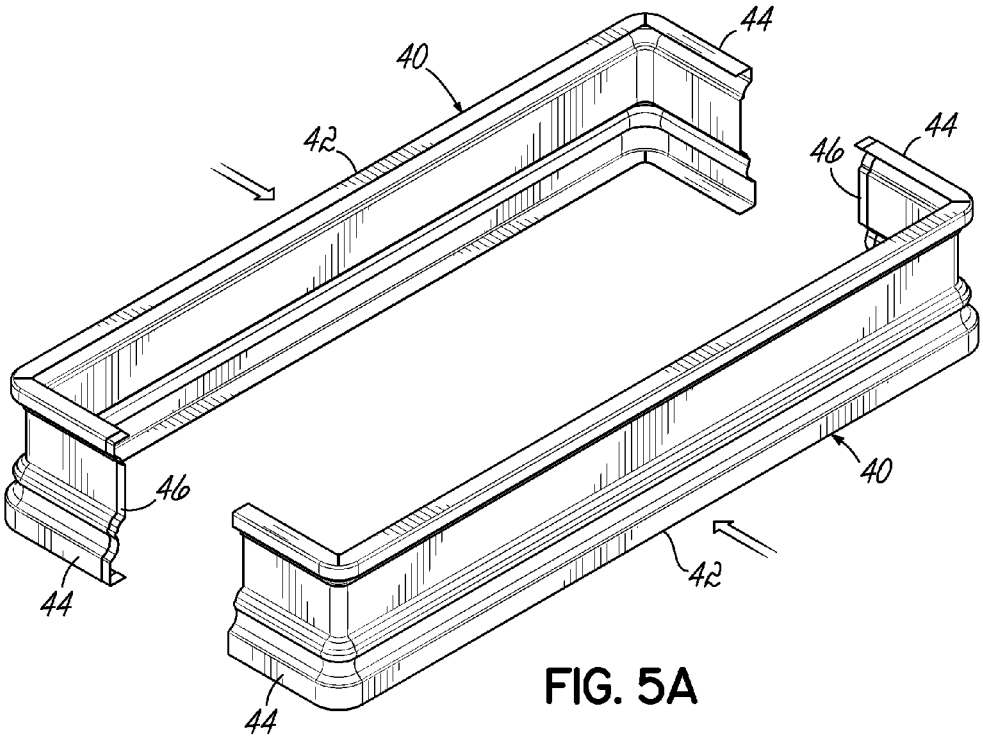
FIG. 5A is an exploded perspective view of two shell halves formed by the process of FIGS. 1-4B.
Figure 5B:
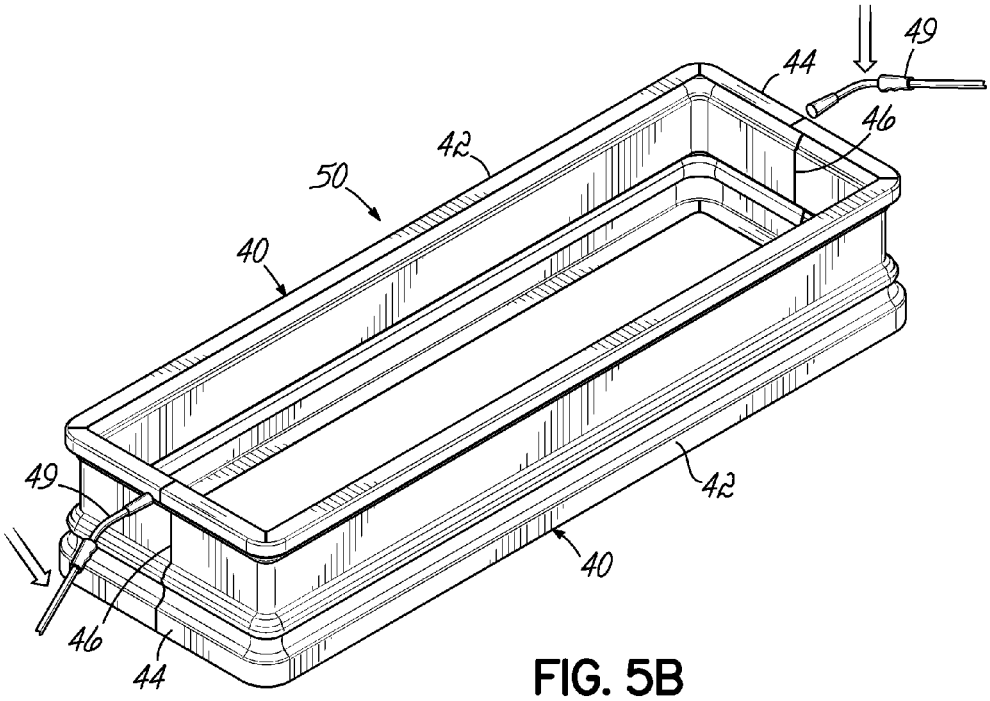
FIG. 5B is an assembled perspective view of the two shell halves of FIG. 5A.
Figure 6A:
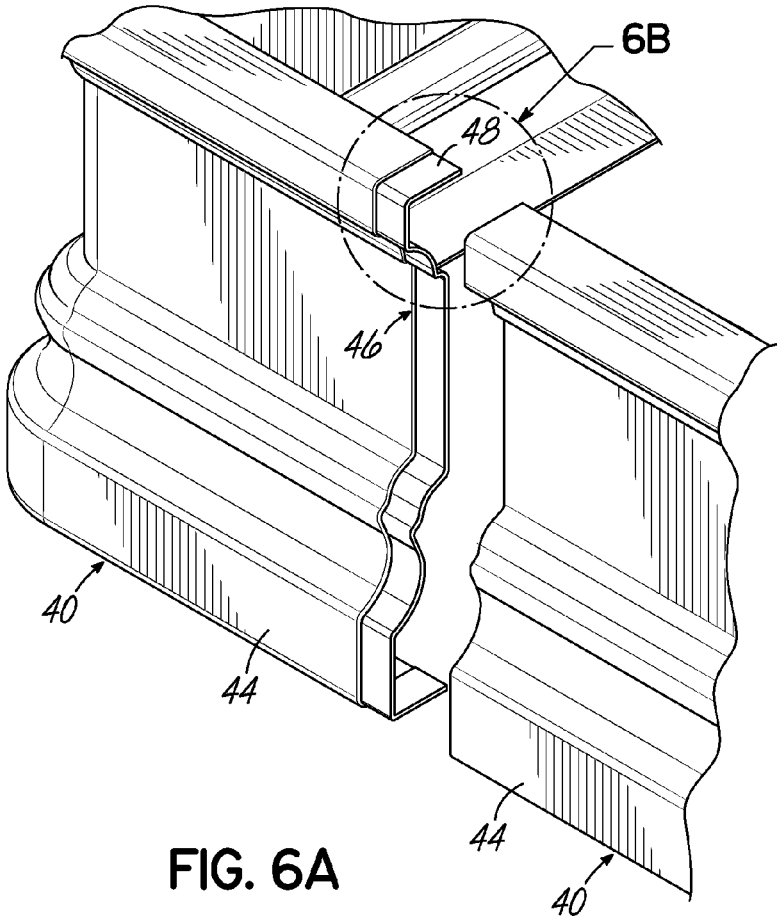
FIG. 6A is a partial perspective view of the mating ends of two shell halves formed by the process of FIGS. 1-4B.
Figure 6B:
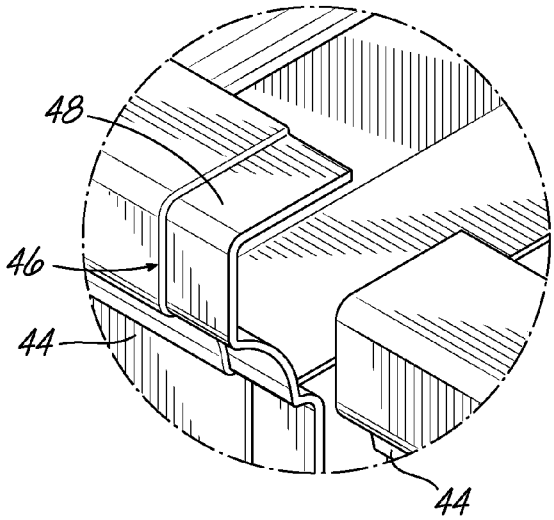
FIG. 6B is an enlarged view of the encircled portion 6B of FIG. 6A.

Referring to FIGS. 5A and 5B, the two shell halves 40, 40 produced by the apparatus 10 are then mated together. Each shell half 40 includes one side wall 42 and about one half of one end wall 44 of the casket shell. A "joggle" 46 can optionally be formed into one of the halves of end wall 44 of one of the shell halves 40 to assist in proper mating with the other half of the end wall 44 of the other shell half 40. The joggle 46 can be formed into the piece of sheet metal 16 prior to insertion into the apparatus 10. The joggle 46 offsets the cross-sectional profile of the shell wall by the thickness of the sheet metal 16 thereby creating a surface 48 that allows the two end wall halves to mate with little to no distortion in the profile between the two parts. In essence, the joggle 46 forms a lap joint. See FIGS. 5B, 6A, and 6B.

Finally, and referring back to FIG. 5B, the halves of the end walls 44, 44 on either end of the shell are then welded together via either manual or robotic welders 49 to complete the shell 50 having side walls 42, 42 and end walls 44, 44. A bottom wall can then be attached to the lower edges of the side walls 42, 42 and end walls 44, 44 of the shell 50, and a sheet metal lid or lids can be fabricated and pivotally mounted to the upper edge of one of the side walls 42, 42 so as to be openable and closeable on the shell 50.

Figure 7:
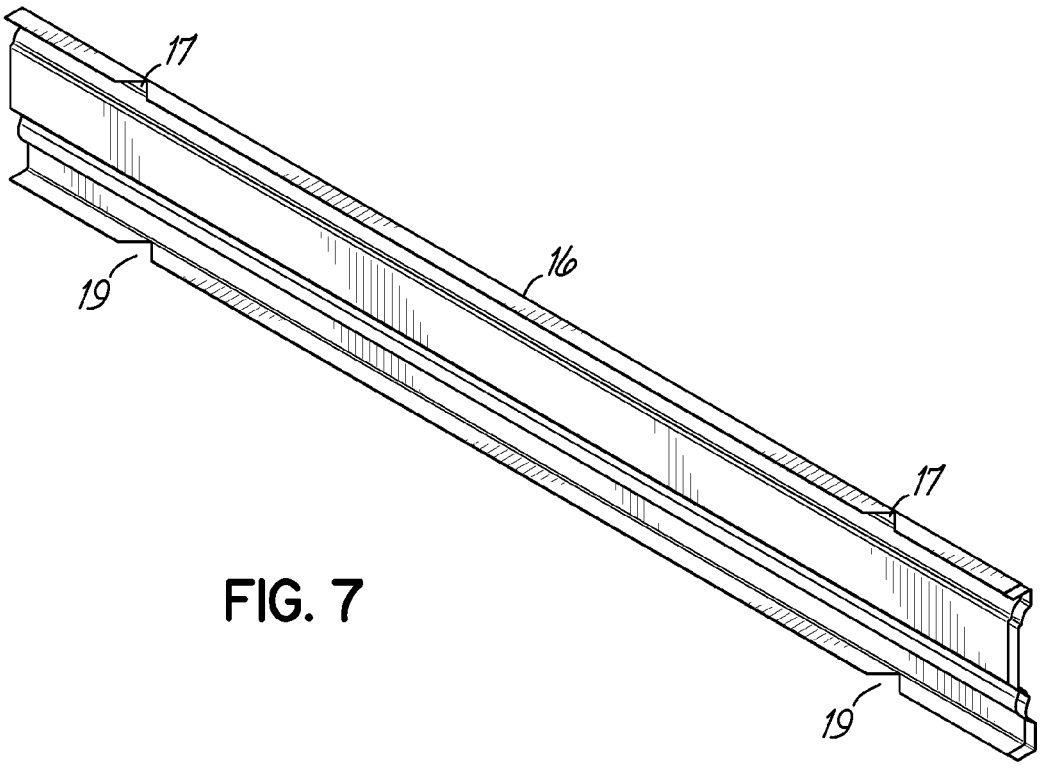
FIG. 7 is an enlarged perspective view of the piece of sheet metal of FIGS. 1, 2A, and 2B.

Referring now to FIG. 7, the piece of sheet metal 16 is illustrated as having upper notches 17, 17 and lower notches 19, 19 in the upper flange and lower flange, respectively, in the regions of the corners. Notches 17, 17 and 19, 19 assist in the forming process in that they help to prevent crimping/kinking of the flanges of the sheet metal during forming of the curved or rounded corners of the shell.

Figure 8A:
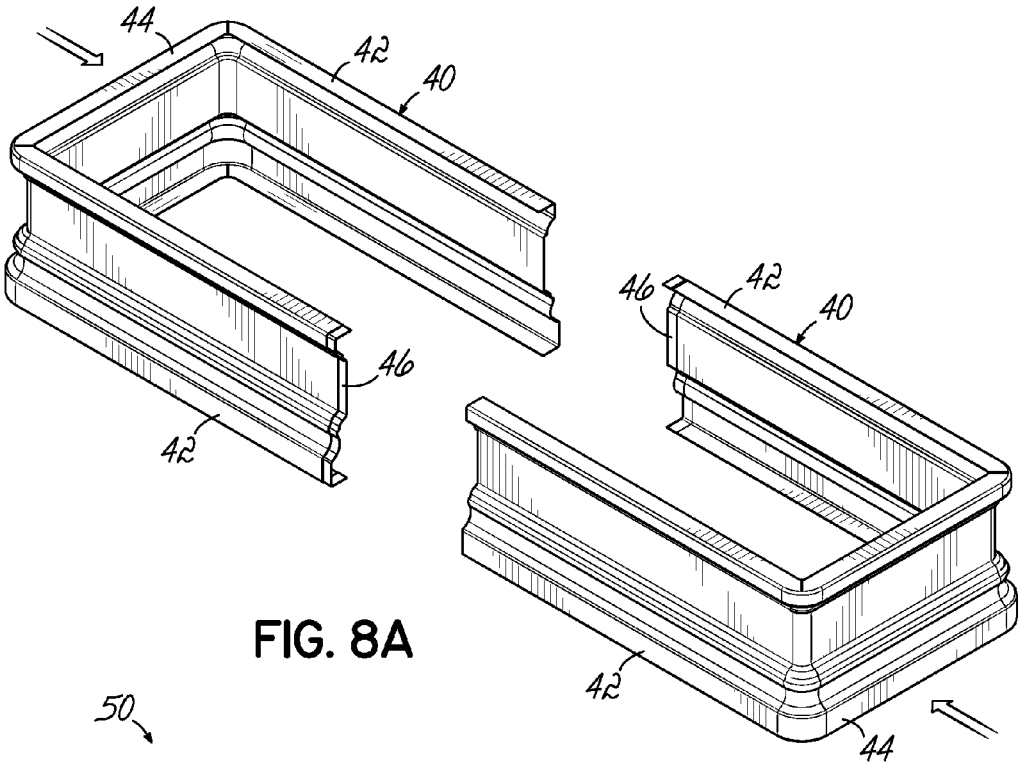
FIG. 8A is an exploded perspective view of two shell halves formed by an alternative embodiment of the present invention.
Figure 8B:
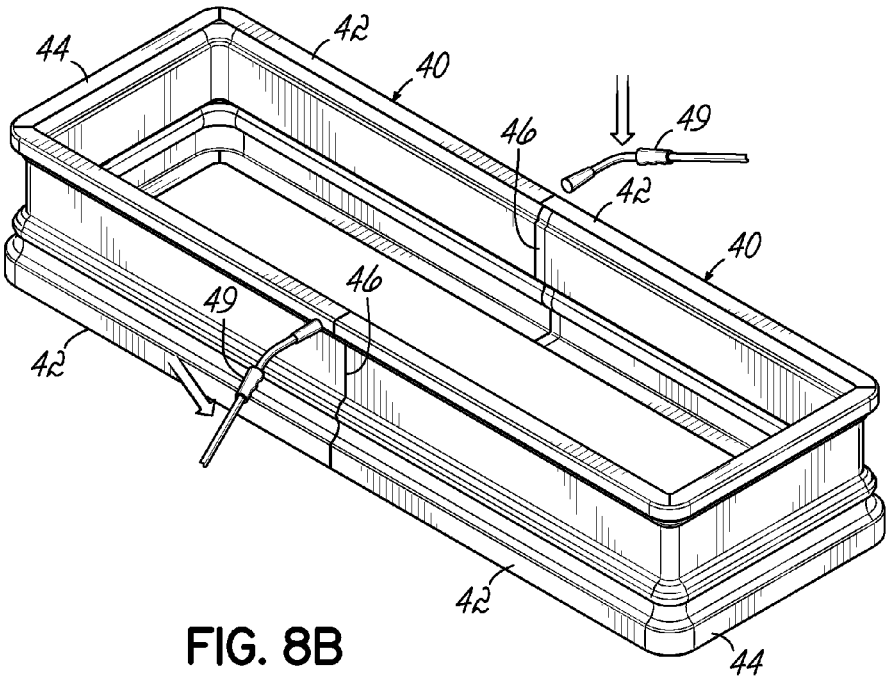
FIG. 8B is an assembled perspective view of the two shell halves of FIG. 8A.

Referring now to FIGS. 8A and 8B, a shell 50 formed by an alternative form of the present invention is illustrated. In this embodiment, rather than forming the shell 50 of two shell halves, each of which has one side wall 42 and about one half of one end wall 44 at each end of the side wall 42, each shell half instead has one end wall 44 and about one half of one side wall 42 at each end of the end wall 44. The halves of the side walls 42, 42 are mated and welded as in the previous embodiment. While not as desirable as the previous embodiment in that the welds appear on the front (or rear) facing side walls 42, 42, nevertheless as in the previous embodiment only two welds are required.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. For example, the length of the piece of sheet metal 16 and/or its positioning between the female 12 and male 14 dies can be such that the two shell halves 40, 40 could be formed with less than or more than one-half of the shell end wall 44 at either end or both ends of the shell half 40. Forming the shell halves with about one-half of the shell end wall 44 at either end of the shell half 40 is convenient from a manufacturing standpoint in that a uniform length of piece of sheet metal 16 and a uniform positioning of the piece of sheet metal 16 in the apparatus can be utilized and is thus preferred, but is certainly not required. Furthermore, and as described, each shell half can also be formed so as to have one end wall 44 and a portion, for example about one half, of one side wall 42 at each end of the end wall 44. Accordingly, the scope of the invention shall be limited only by the following claims and their equivalents.

What is claimed is:

1. A method of forming a portion of a sheet metal casket shell, the casket shell having a pair of opposed side walls and a pair of opposed end walls, the portion of the casket shell being formed from a piece of sheet metal having a desired profile, opposite ends, and a length about equal to the combined length of one of the side walls and one of the end walls of the casket shell, the method comprising the steps of:

supporting the piece of sheet metal on one side with a female die having a center die portion and opposite end die portions configured to pivot relative to the center die portion, supporting the piece of sheet metal on the opposite side with a male die having a center die portion and opposite end die portions, and pivoting the end die portions of the female die relative to the center die portion of the female die to cause the opposite ends of the piece of sheet metal to fold around the end die portions of the male die, the resulting portion of the casket shell having a side wall, about half of one end wall at one end of the side wall, and about half of the other end wall at the other end of the side wall.

2. The method of claim 1 wherein the desired profile is roll formed into the piece of sheet metal.

3. The method of claim 1 wherein the end die portions of the male die are curved.

4. The method of claim 3 wherein the end die portions of the male die are rollers.

5. A method of forming a sheet metal casket shell, the casket shell having a pair of opposed side walls and a pair of opposed end walls, the method comprising the steps of:

providing a first piece of sheet metal having a desired profile, opposite ends, and a length about equal to the combined length of one of the side walls and one of the end walls of the casket shell, supporting the first piece of sheet metal on one side with a female die having a center die portion and opposite end die portions configured to pivot relative to the center die portion, supporting the first piece of sheet metal on the opposite side with a male die having a center die portion and opposite end die portions, pivoting the end die portions of the female die relative to the center die portion of the female die to cause the opposite ends of the first piece of sheet metal to fold around the end die portions of the male die to form a first portion of the casket shell having a side wall, about half of one end wall at one end of the side wall, and about half of the other end wall at the other end of the side wall, providing a second piece of sheet metal having the desired profile, opposite ends, and a length about equal to the combined length of one of the side walls and one of the end walls of the casket shell, supporting the second piece of sheet metal on one side with the female die, supporting the second piece of sheet metal on the opposite side with the male die, pivoting the end die portions of the female die relative to the center die portion of the female die to cause the opposite ends of the second piece of sheet metal to fold around the end die portions of the male die to form a second portion of the casket shell having a side wall, about half of one end wall at one end of the side wall, and about half of the other end wall at the other end of the side wall, positioning the first and second portions of the casket shell so that the half end walls of each portion abut, and welding the abutting half end walls together.

6. The method of claim 5 wherein the desired profile is roll formed into the first and second pieces of sheet metal.

7. The method of claim 5 wherein the end die portions of the male die are curved.

8. The method of claim 7 wherein the end die portions of the male die are rollers.

9. A method of forming a portion of a sheet metal casket shell, the casket shell having a pair of opposed side walls and a pair of opposed end walls, the portion of the casket shell being formed from a piece of sheet metal having a desired profile and opposite ends, the method comprising the steps of:

supporting the piece of sheet metal on one side with a female die having a center die portion and opposite end die portions configured to pivot relative to the center die portion, supporting the piece of sheet metal on the opposite side with a male die having a center die portion and opposite end die portions, and pivoting the end die portions of the female die relative to the center die portion of the female die to cause the opposite ends of the piece of sheet metal to fold around the end die portions of the male die, the resulting portion of the casket shell having a side wall, a portion of one end wall at one end of the side wall, and a portion of the other end wall at the other end of the side wall.

10. The method of claim 9 wherein the desired profile is roll formed into the piece of sheet metal.

11. The method of claim 9 wherein the end die portions of the male die are curved.

12. The method of claim 11 wherein the end die portions of the male die are rollers.

13. The method of claim 9 further comprising the steps of:

repeating the steps of claim 9 with a second piece of sheet metal to form a second portion of the casket shell having a side wall, a portion of one end wall at one end of the side wall, and a portion of the other end wall at the other end of the side wall, abutting respective end wall portions of the two casket shell portions, and welding the respective abutting end wall portions of the two casket shell portions together.

14. A method of forming a portion of a sheet metal casket shell, the casket shell having a pair of opposed side walls and a pair of opposed end walls, the portion of the casket shell being formed from a piece of sheet metal having a desired profile and opposite ends, the method comprising the steps of:

supporting the piece of sheet metal on one side with a female die having a center die portion and opposite end die portions configured to pivot relative to the center die portion, supporting the piece of sheet metal on the opposite side with a male die having a center die portion and opposite end die portions, and pivoting the end die portions of the female die relative to the center die portion of the female die to cause the opposite ends of the piece of sheet metal to fold around the end die portions of the male die, the resulting portion of the casket shell having either a) a side wall, a portion of one end wall at one end of the side wall, and a portion of the other end wall at the other end of the side wall, or b) an end wall, a portion of one side wall at one end of the end wall, and a portion of the other side wall at the other end of the end wall.

15. The method of claim 14 wherein the desired profile is roll formed into the piece of sheet metal.

16. The method of claim 14 wherein the end die portions of the male die are curved.

17. The method of claim 16 wherein the end die portions of the male die are rollers.

18. The method of claim 14 further comprising the steps of:

repeating the steps of claim 14 with a second piece of sheet metal to form a second portion of the casket shell, mating the two casket shell portions, and welding respective abutting end wall portions or side wall portions of the two casket shell portions together.

19. The method of claim 18 wherein each of the resulting portions of the casket shell has a side wall, about one half of one end wall at one end of the side wall, and about one half of the other end wall at the other end of the side wall.

20. The method of claim 18 wherein each of the resulting portions of the casket shell has an end wall, about one half of one side wall at one end of the end wall, and about one half of the other side wall at the other end of the end wall.

* * * * *